US007013619B2

(12) United States Patent
Hoover

(10) Patent No.: US 7,013,619 B2
(45) Date of Patent: Mar. 21, 2006

(54) PROPERTY AND EVIDENCE PRESERVATION SYSTEM

(75) Inventor: Cory J. Hoover, Clearwater, FL (US)

(73) Assignee: Clearwater Packaging, Inc., Clearwater, FL (US)

( * ) Notice: Subject to any disclaimer, the term of this patent is extended or adjusted under 35 U.S.C. 154(b) by 0 days.

(21) Appl. No.: 10/862,732

(22) Filed: Jun. 7, 2004

(65) Prior Publication Data

US 2005/0268574 A1 Dec. 8, 2005

(51) Int. Cl.
*B65B 11/52* (2006.01)

(52) U.S. Cl. ..... 53/427; 53/461; 53/509

(58) Field of Classification Search ..... 53/427, 53/461, 509; 206/223, 543, 460, 495, 497
See application file for complete search history.

(56) References Cited

U.S. PATENT DOCUMENTS

| | | | | | |
|---|---|---|---|---|---|
| 3,363,395 | A | | 1/1968 | King | |
| 3,650,775 | A | | 3/1972 | Simon et al. | |
| 3,860,117 | A | * | 1/1975 | Walus et al. | 206/461 |
| 3,950,870 | A | * | 4/1976 | Heegaard | 40/638 |
| 3,950,919 | A | | 4/1976 | Perdue | |
| 4,062,449 | A | * | 12/1977 | Popkes et al. | 206/471 |
| 4,064,676 | A | | 12/1977 | King et al. | |
| 4,077,184 | A | * | 3/1978 | Kremer et al. | 53/509 |
| 4,091,927 | A | * | 5/1978 | Lunsford | 206/459.5 |
| 4,128,954 | A | * | 12/1978 | White | 40/310 |
| 4,164,109 | A | | 8/1979 | Dubois | |
| 4,262,050 | A | | 4/1981 | Jenkins | |
| 4,910,033 | A | * | 3/1990 | Bekele et al. | 426/129 |
| 4,919,955 | A | * | 4/1990 | Mitchell | 426/394 |
| 5,165,220 | A | | 11/1992 | Puett | |
| 5,186,900 | A | * | 2/1993 | Jensen et al. | 422/104 |
| 5,551,729 | A | * | 9/1996 | Morgan | 283/94 |
| 5,591,468 | A | * | 1/1997 | Stockley et al. | 426/106 |
| 5,635,917 | A | * | 6/1997 | Todman | 340/825.37 |
| D386,077 | S | * | 11/1997 | Chen | D9/415 |
| 5,937,618 | A | * | 8/1999 | Chandler | 53/427 |
| 6,030,655 | A | * | 2/2000 | Hansmire et al. | 427/1 |
| 6,076,859 | A | * | 6/2000 | Hall et al. | 283/89 |
| 6,285,285 | B1 | * | 9/2001 | Mongrenier | 340/572.8 |
| 6,321,509 | B1 | | 11/2001 | DelDuca et al. | |
| 6,632,403 | B1 | * | 10/2003 | Barmore et al. | 422/102 |
| 6,816,075 | B1 | * | 11/2004 | Grunes et al. | 340/572.1 |
| 6,843,039 | B1 | * | 1/2005 | Hanmer | 53/427 |
| 2002/0113707 | A1 | * | 8/2002 | Grunes et al. | 340/572.1 |
| 2004/0049396 | A1 | * | 3/2004 | Hope | 705/1 |

OTHER PUBLICATIONS

Medallion Smoked Salmon, Internet Home Page, Jun. 2001, http://smokedsalmon.insn.net/index.html, Home page, Gifts page, Products page.*

* cited by examiner

*Primary Examiner*—Stephen F. Gerrity
*Assistant Examiner*—Brian Nash
(74) *Attorney, Agent, or Firm*—Fraser Martin & Miller LLC; Donald R. Fraser

(57) ABSTRACT

A method of preserving evidence and later returning the same utilizing a package having an optically transparent film incorporating the evidence and a signed itemization thereof to produce a tamper evident package.

16 Claims, 2 Drawing Sheets

PROPERTY AND EVIDENCE PRESERVATION SYSTEM

BACKGROUND OF THE INVENTION

1. Field of the Invention

The invention relates generally to the preservation of an inventory of items for subsequent return or use and, more particularly, to a method of preservation of the personal property of an individual charged with a crime and sentenced to be incarcerated in a prison, for example, and the subsequent return of the property.

2. Description of the Prior Art

The problem of protecting the personal property of a prison inmate has been a long recognized problem. Oftentimes when the personal property is retrieved by the owner after being stored, it has been found that certain items were missing from the inventory.

Many attempts have been made to seal the personal property in various containers containing an integral itemized listing of the inventory. However, in many instances, upon the return of the inventory to the owner, items have been found to be missing from the itemized inventory.

SUMMARY OF THE INVENTION

It is an object of the present invention to produce a method of preserving the integrity of personal property for later retrieval wherein the personal property and an associated itemization thereof may be readily and easily viewed for later use of the property as evidence in a court proceeding or the return thereof to the owner.

It is another object of the invention to produce a method of preserving the integrity of personal property and the chain of possession thereof in a tamper evident package for subsequent return to the owner.

Another object of the invention is to produce a method of preserving the integrity of personal property along with a viewable acknowledged inventory itemization for subsequent verification.

The above as well as other objects and advantages of the invention may be typically achieved by a method of preserving discrete inventory of personal property for later return including the steps of providing an inventory of property to be preserved; providing an itemization of the property; placing the property and itemization of the property in a viewable tamper evident package; and sealing the package.

BRIEF DESCRIPTION OF THE DRAWING

The above and other objects of the invention will become readily manifest to one skilled in the art from reading the following detailed description of the invention in the light of the accompanying drawing in which.

DETAILED DESCRIPTION OF THE PREFERRED EMBODIMENT

Figure 1:
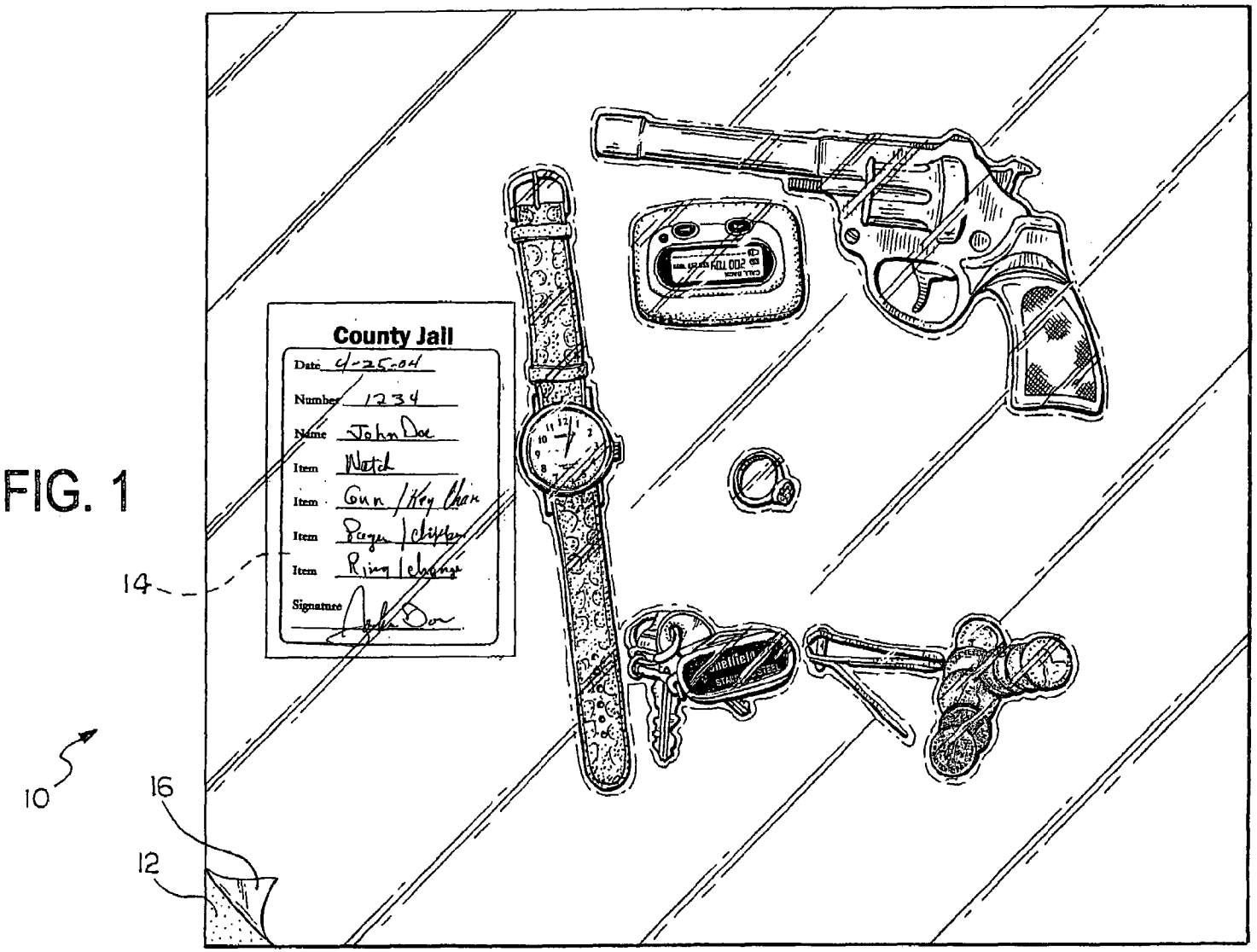
FIG. 1 is a plan view of a package formed by the novel steps of the present invention showing a portion of the plastic film covering being removed to show the underlying board.
Figure 2:
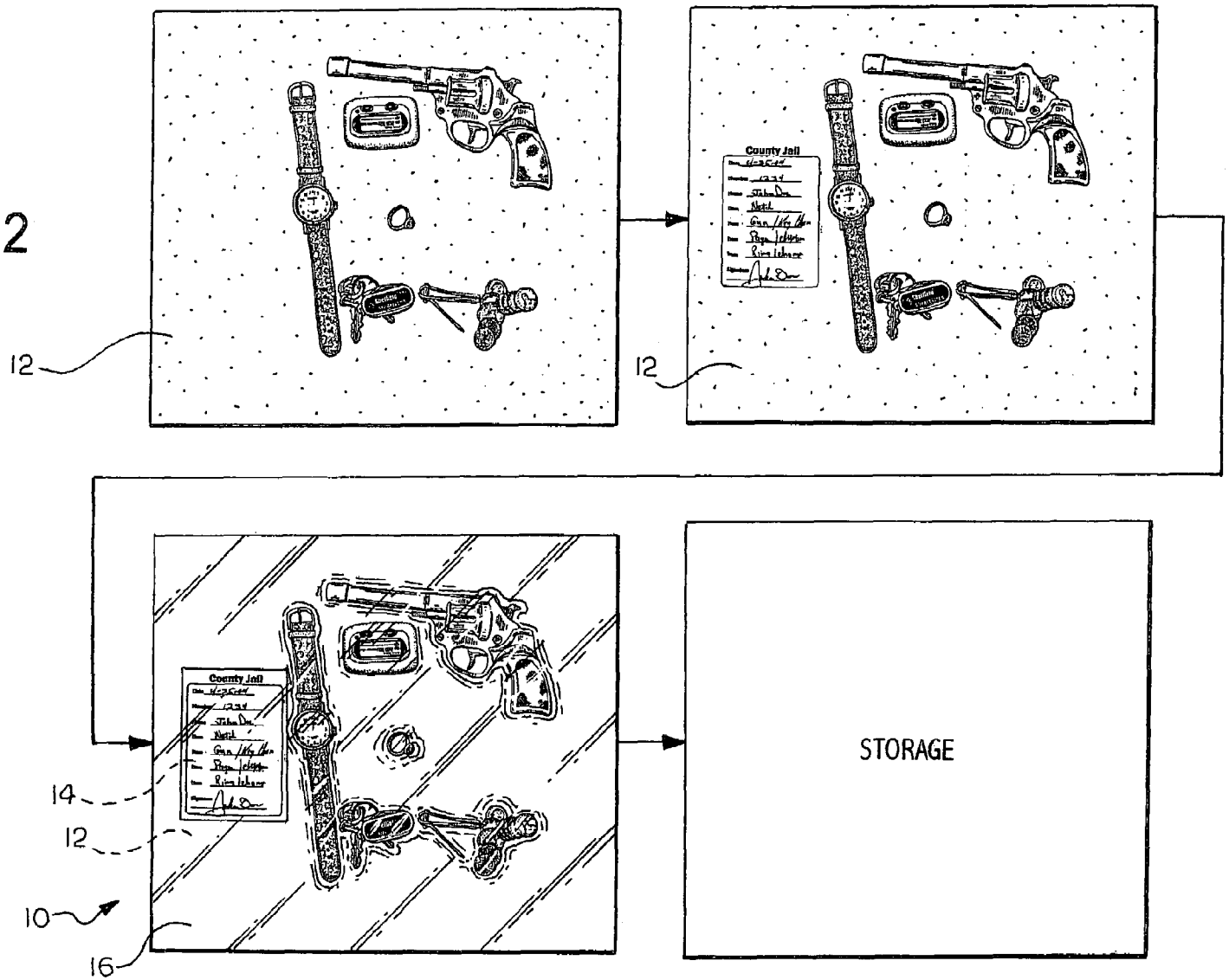
FIG. 2 is a diagrammatic depiction of the typical basic steps for carrying out the objectives of the invention wherein the basic steps are illustrated in diagrammatic block form.

Referring to the drawings, there is illustrated in FIG. 1 a package formed by the basic steps illustrated diagrammatically in block form in FIG. 2.

More specifically, there is illustrated a package 10 for containing the personal items in a viewable, tamper evident manner.

As illustrated in FIG. 2, the steps for forming the package 10 of FIG. 1 includes the initial step of providing a base consisting of a porous board 12 such as, for example, a packaging board produced by International Paper Company and sold under the trademark EVEREST SKINBRITE 24 PT.

The board 12 is typically printed and coated with a thermoplastic adhesive (heat seal coating). The heat seal coating may be a product manufactured and sold by Sovereign Packaging Group, Inc. of Buffalo, N.Y. 14241 under the trademark LATISEAL.

The items of personal property are then placed in spaced relation on the upwardly facing surface of the board 12. An itemization 14 containing a listing of the inventory of personal property is dated and signed by the owner of the property and placed on the surface of the board 12 with the inventory listing, date, and signature facing upward.

Next, an optically transparent and impervious sealing film 16 is heated, directed over the upwardly facing of the board 12, applied around the various items of personal property and against the heat seal coating on the upwardly facing surface of the board 12. A vacuum is simultaneously drawn through the pores in the board 12 forcing the film tightly around the individual items and is superposed adjacent relative to the head seal coating on the upward facing surface of the board 12. This action simultaneously encapsulates the individual items of personal property and seals the film to the board 12. Along with the items of personal property being sealed, the itemization 14 is likewise sealed. The package 10 thereby provides a view of the personal property and the associated itemization 14, and, thereby, will make it readily apparent if any tampering later occurs, or if any of the items are missing.

The completed package 10 may then be transferred to a storage facility for return to the individual upon release from incarceration. It may be understood that the completed package 10 may contain articles which may later be required as evidence in a criminal proceeding. In such instance, the items may be readily located and introduced into evidence with ease.

While there may be a number of machines or equipment utilized in carrying out the certain steps of the invention, it has been found that satisfactory results have been obtained with the employment of a skin packaging machine manufactured by Audion Automation of Dallas, Tex. and sold under the trademark VACUMASTER. The VACUMASTER machine is employed to enclose the contents between juxtaposed sheet material comprising a flat base sheet and a covering sheet in which the covering sheet is forced by fluid pressure; e.g., vacuum into tight engagement with the contents and is secured at its free margins to the base sheet to form a thin, skin-like covering over the contents.

The machine typically utilizes a polyethylene resin sealing film which is optically transparent and manufactured by DuPont Company, Wilmington, Del. and sold under the trademark SURLYN 1601-2 packaging resin. The resultant film is thermoformable and provides product protection and a reliable heat seal.

While it has been mentioned that the intemization 14 was provided with a certifying verification signature of the owner, it will be understood that the signature could be supplemented and/or replaced by a thumb or fingerprint of the owner or some other identifying mark between the plastic film and the packaging board 12.

The aforedescribed method has produced a tamper evident package and puts to rest any questions about the package being opened when the owner is not present.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A method of preserving the integrity of discrete inventory of personal property for maintenance by law enforcement officials and later return thereof to an owner including the steps of:

assembling an inventory of personal property from the owner thereof to be preserved;

preparing a printed itemization of said inventory;

providing a supporting base for the support of said inventory;

placing at least a portion of said base, said inventory, and said printed itemization in a viewable tamper evident package; and sealing said package for subsequent return to the owner of the personal property, wherein said printed itemization is encapsulated in said package to militate against tampering therewith and provide visual evidence of tampering.

2. The method defined in claim 1 wherein said printed itemization includes the signature of the owner of said inventory.

3. The method defined in claim 1 wherein said tamper evident package further includes a transparent covering.

4. The method defined in claim 3 wherein said covering is vacuumed formed to said base.

5. The method defined in claim 3 wherein said covering is a thin plastic film.

6. A method of preserving the integrity of items of personal property for later return to an owner of the personal property including the steps of:

assembling items of personal property;

preparing a printed itemization of said items of personal property;

providing a base for the support of said items of personal property;

placing said items of personal property and said printed itemization on said base; and skin wrapping said items of personal property and said printed itemization to said base, wherein said printed itemization is encapsulated to militate against tampering therewith and provide visual evidence of tampering.

7. The method defined in claim 6 wherein said skin wrapping includes the use of an optically transparent film of plastic material.

8. The method defined in claim 7 wherein said base includes a porous board.

9. The method defined in claim 8 wherein said porous board includes a layer of adhesive.

10. The method defined in claim 9 wherein said adhesive is heat sensitive.

11. The invention defined in claim 10 wherein said printed itemization contains an indicia of the owner of said items of personal property.

12. The invention defined in claim 11 wherein said indicia includes the signature of the owner of said items of personal property.

13. A method of preserving the integrity of items of personal property for later return to an owner of the personal property including the steps of:

assembling items of personal property from the owner thereof to be preserved;

preparing a printed itemization of the property;

providing a base for supporting of said items of personal property;

obtaining a signature of the owner of the property on the printed itemization to verify the contents of the printed itemization; and encapsulating the property, at least a portion of the base, and the printed itemization in a package, wherein the printed itemization is viewable from an outside of the package and an attempt to tamper with at least one of the property and the printed itemization is evidenced by physical damage to the package.

14. The method defined in claim 13 further comprising the step of providing a covering for vacuum forming to the base to form the package.

15. The method defined in claim 14 wherein the covering is a thin plastic film.

16. The method defined in claim 14 wherein said covering is a transparent plastic film.

* * * * *